US009067257B2

(12) United States Patent
White

(10) Patent No.: US 9,067,257 B2
(45) Date of Patent: Jun. 30, 2015

(54) APPARATUS AND METHODS FOR BENDING WIRE

(75) Inventor: Wyatt A. White, Coatesville, PA (US)

(73) Assignee: Wire and Cable Specialties, Inc., Coatesville, PA (US)

( * ) Notice: Subject to any disclaimer, the term of this patent is extended or adjusted under 35 U.S.C. 154(b) by 502 days.

(21) Appl. No.: 13/524,282

(22) Filed: Jun. 15, 2012

(65) Prior Publication Data

US 2012/0318401 A1 Dec. 20, 2012

Related U.S. Application Data

(60) Provisional application No. 61/497,226, filed on Jun. 15, 2011.

(51) Int. Cl.
*B21F 1/00* (2006.01)
*B25B 7/02* (2006.01)

(52) U.S. Cl.
CPC .. *B21F 1/002* (2013.01); *B25B 7/02* (2013.01)

(58) Field of Classification Search
CPC ..... B21F 1/002; B21F 1/04; B21F 1/06; A61C 7/04; H01R 43/042; B25B 7/02
USPC ..... 140/105, 106, 117, 121, 123, 124
See application file for complete search history.

(56) References Cited

U.S. PATENT DOCUMENTS

| | | | | |
|---|---|---|---|---|
| 156,054 | A | 10/1874 | Burger | |
| 468,189 | A * | 2/1892 | Buckingham | 140/121 |
| 782,868 | A | 2/1905 | Morgan | |
| 2,755,692 | A * | 7/1956 | Wallshein | 72/390.5 |
| 3,244,201 | A * | 4/1966 | Wallshein | 140/106 |
| 3,421,553 | A | 1/1969 | Redmon | |
| 3,457,764 | A | 7/1969 | McKee | |
| 4,091,845 | A | 5/1978 | Johnson | |
| 4,423,757 | A | 1/1984 | Broberg, Jr. | |
| 4,637,084 | A | 1/1987 | Wood | |
| 6,253,798 | B1 | 7/2001 | Helwig | |
| 6,984,126 | B1 | 1/2006 | Graham | |
| 8,622,096 | B2 * | 1/2014 | Yang | 140/123 |
| 2007/0137725 | A1 | 6/2007 | Conde | |

OTHER PUBLICATIONS http://www.amazon.com/Pliers Rosary Beading Jewelry Wire Shaping Tool 5.5, pp. 1-5, May 27, 2011.
http://www.riggenho.com/howtoiso.htm, How to Create a Riggen HO Scale Iso-pivot Chassis, pp. 1-9, May 27, 2011.

* cited by examiner

*Primary Examiner* — Debra Sullivan
(74) *Attorney, Agent, or Firm* — Petock and Petock, LLC; Joseph E. Maenner

(57) ABSTRACT

An apparatus for bending wire is disclosed. The apparatus for bending wire comprises a pair of forming parts pivotably connected at a joint. The first forming part has a receiving section and the second forming part has a projecting section. The receiving section has a bottom surface and a pair of opposing sidewalls extending toward the second forming part. The projecting section has a projection extending toward the first forming part. The receiving section and the projecting section are sized to bend a wire into a pair of substantially right angles when the wire is positioned between the receiving section and the projecting section and when the second forming part is pivoted such that the projection is received between the pair of opposing sidewalls. A method for bending wire with the above-described apparatus is also disclosed.

19 Claims, 4 Drawing Sheets

APPARATUS AND METHODS FOR BENDING WIRE

CROSS REFERENCE TO RELATED APPLICATIONS

This application claims priority to U.S. Patent Application No. 61/497,226, entitled "APPARATUS AND METHODs FOR BENDING WIRE," filed on Jun. 15, 2011, the contents of which are incorporated herein by reference in their entirety.

FIELD OF THE INVENTION

This invention relates generally to bending wire, and more particularly, to apparatus and methods for wire banding applications.

BACKGROUND OF THE INVENTION

In the jewelry art, the term "wire banding" generally refers to the process of wrapping half-round/half-square wire (hereinafter "half-round wire") or square wire around multiple lengths of square or rectangular wire. Conventional jewelry elements may be created by wrapping or banding half-round wire or square wire around square wire to create a framework for setting stones or creating components.

When banding the half-round wire or square wire around square or rectangular wire, it may be difficult to get the correct angle of the first band snugly about the square wire. Thus, apparatus and methods are desired to enable persons with minimal jewelry making skills to effectively perform wire banding.

SUMMARY OF THE INVENTION

Aspects of the present invention are related to apparatus and methods for bending wire.

In accordance with one aspect of the present invention, an apparatus for bending wire is disclosed. The apparatus comprises a first forming part and a second forming part pivotably connected to the first forming part at a joint. Each of the first and second forming parts having a respective proximal end and a respective distal end positioned on opposing sides of the joint. The first forming part has a receiving section at the distal end thereof. The receiving section has a bottom surface and a pair of opposing sidewalls extending from the bottom surface in a direction toward the second forming part. The second forming part has a projecting section at the distal end thereof. The projecting section has a projection extending toward the first forming part. The projection is positioned to be received between the pair of opposing sidewalls of the receiving section. The receiving section and the projecting section are sized to bend a wire into a pair of substantially right angles when the wire is positioned between the receiving section and the projecting section and when the second forming part is pivoted such that the projection is received between the pair of opposing sidewalls.

In accordance with another aspect of the present invention, a method for bending wire is disclosed. The method comprises the steps of positioning half-round wire or square wire across the receiving section of the above-described apparatus, and pivoting the second forming part relative to the first forming part such that the projection contacts the wire and is received between the pair of opposing sidewalls, thereby bending the wire into a pair of substantially right angles.

BRIEF DESCRIPTION OF THE DRAWINGS

The invention is best understood from the following detailed description when read in connection with the accompanying drawings, with like elements having the same reference numerals. When a plurality of similar elements are present, a single reference numeral may be assigned to the plurality of similar elements with a small letter designation referring to specific elements. When referring to the elements collectively or to a non-specific one or more of the elements, the small letter designation may be dropped. According to common practice, the various features of the drawings are not drawn to scale unless otherwise indicated. To the contrary, the dimensions of the various features may be expanded or reduced for clarity. Included in the drawings are the following figures.

DETAILED DESCRIPTION OF THE INVENTION

Figure 5:
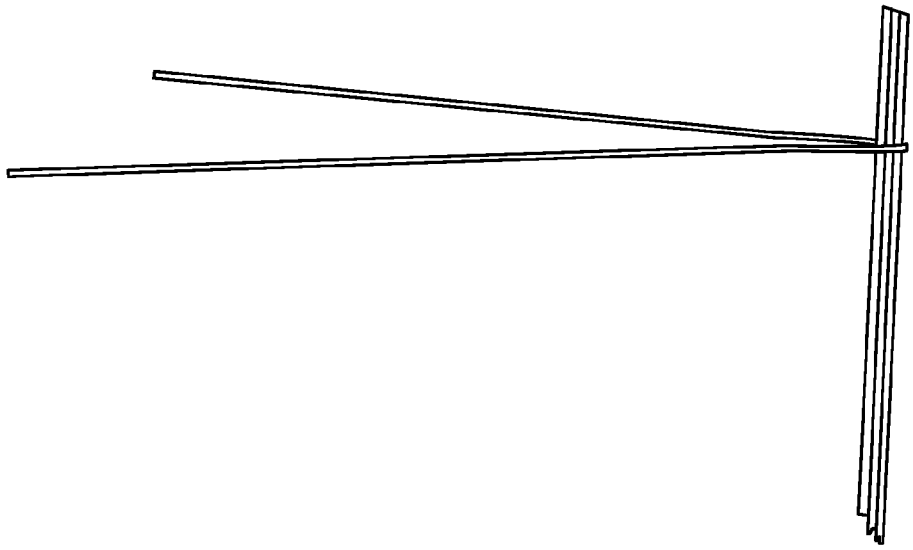
FIG. 5 is an image illustrating an exemplary process for banding wire in accordance with aspects of the present invention.
Figure 6:
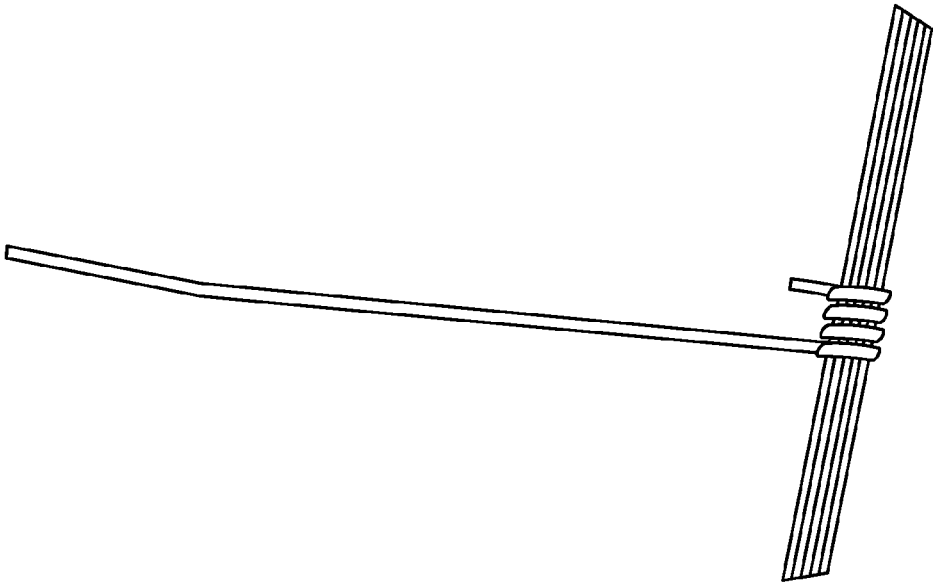
FIG. 6 is another image illustrating the exemplary process for banding wire of FIG. 4.

Aspects of the present invention are directed to apparatus and methods that address the above problem by creating a properly-sized double right angle in the half-round and square wire, in order to tightly begin banding the wire. It will be appreciated by one of ordinary skill in the art that a tightly banded beginning creates a firm foundation for forming the base piece of jewelry. Exemplary images of a wire banding process enabled by the present invention are shown in FIGS. 5 and 6. Aspects of the present invention are usable to enable rapid formation of the initial band and faster completion of a piece of jewelry.

Aspects of the present invention are described herein with respect to jewelry wire (e.g. half-round jewelry wire or square jewelry wire). However, it will be understood by one of ordinary skill in the art that the exemplary apparatus and methods disclosed herein are usable on any suitably-sized wire, and are not limited to use in jewelry.

In accordance with one aspect of the present invention, a set of jewelry wire banding pliers are disclosed. The pliers are operable to compressively form half-round wire and square wire into a shape appropriately sized for banding onto square wires of varying sizes. The pliers may desirably form the wire into this shape using a single compressive forming step. Methods of using the disclosed wire banding pliers are also disclosed.

Figure 1:
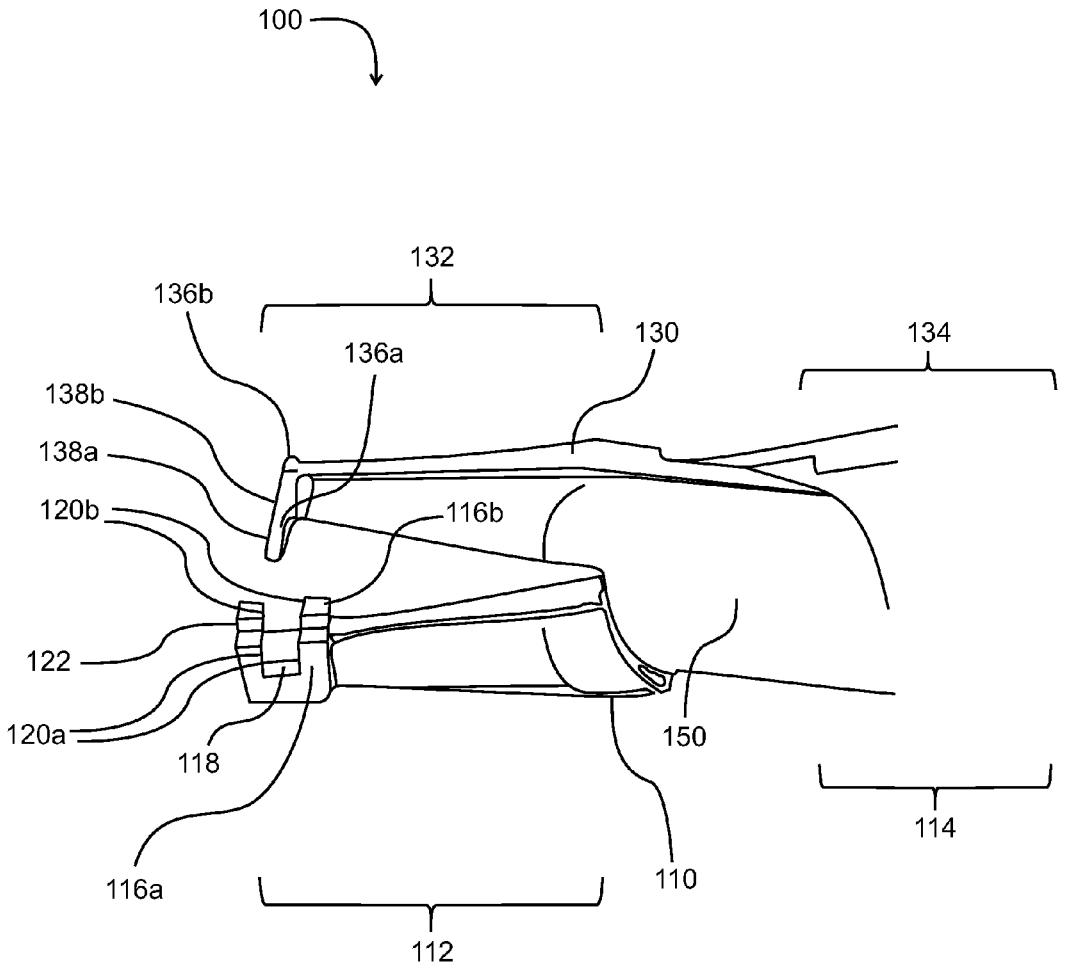
FIG. 1 is a diagram illustrating an exemplary apparatus for bending wire in accordance with aspects of the present invention.
Figure 2:
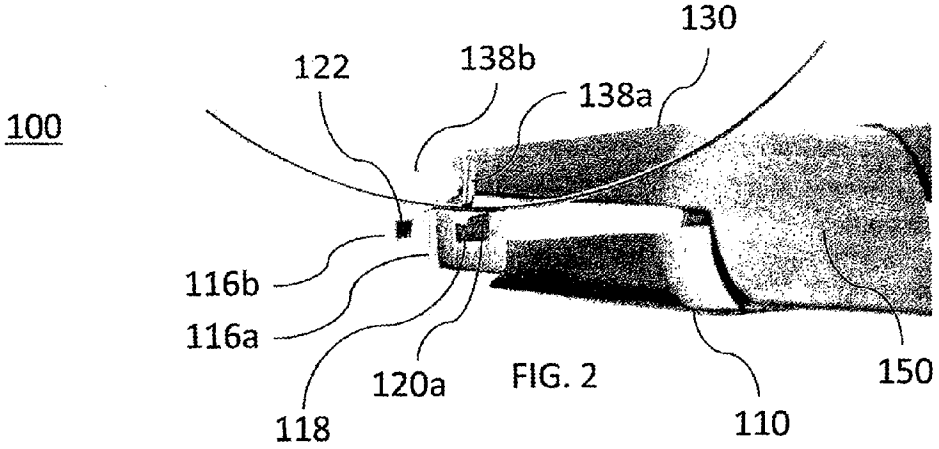
FIG. 2 is an image illustrating the exemplary apparatus of FIG. 1 in a partially closed position.
Figure 3:
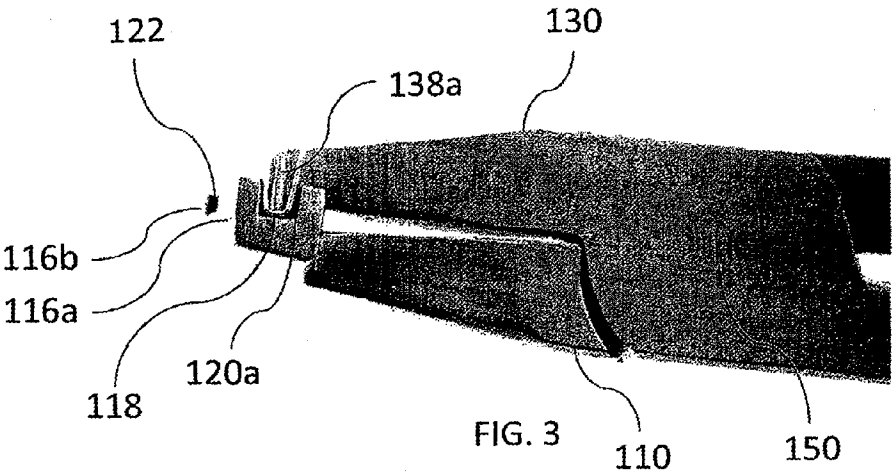
FIG. 3 is an image illustrating the exemplary apparatus of FIG. 1 in a fully closed position.

FIGS. 1-3 illustrate an exemplary apparatus 100 for bending wire in accordance with aspects of the present invention. Apparatus 100 is operable to bend wire into a double right angle curve. As a general overview, apparatus 100 includes a first forming part 110, a second forming part 130, and a joint 150. Additional details of apparatus 100 are described below.

First forming part 110 and second forming part 130 are pivotably connected to one another at joint 150. First forming part 110 and second forming part 130 have respective distal ends 112 and 132 and respective proximal ends 114 and 134 positioned on opposing sides of joint 150. As used herein, the term "end" refers to the entire portion of respective forming part positioned on the distal or proximal side of joint 150. Joint 150 may be positioned approximately at the middle of first and second forming parts 110 and 130, or may be closer to the proximal or distal ends of first and second forming parts 110 and 130. Preferably, joint 150 is positioned closer to distal ends 112 and 132 of first and second forming parts 110 and 130, in order to enable a user of apparatus 100 to impart sufficient force to bend the wire.

In an exemplary embodiment, first and second forming parts 110 and 130 are formed from metals such as steel or a steel alloy. Other suitable materials for forming first and second forming parts 110 and 130 will be known to one of ordinary skill in the art from the description herein. In an exemplary embodiment, joint 150 is a rivet that attaches second forming part 130 to first forming part 110. Other suitable structures for use as joint 150 will be known to one of ordinary skill in the art from the description herein.

First forming part 110 has a receiving section 116 at distal end 112. Receiving section 116 receives the wire bent by apparatus 100 during operation. As shown in FIG. 1, receiving section 116 has a bottom surface 118 positioned between a pair of opposing sidewalls 120. Sidewalls 120 extend upward from bottom surface 118 toward second forming part 130.

Second forming part 130 has a projecting section 136 at distal end 132. Projecting section 136 bends the wire during operation of apparatus 100. As shown in FIG. 1, projecting section 136 has a projection 138 extending toward first forming part 110. Projection 138 is positioned to be received between sidewalls 120 of receiving section 116 when apparatus 100 is in the closed position (as shown in FIG. 3).

Receiving section 116 and projecting section 136 are sized to bend a wire into a pair of substantially right angles when operated, i.e., when the wire is positioned between receiving section 116 and projecting section 136 (as shown in FIG. 2), and when second forming part 130 is pivoted such that projection 138 is received between sidewalls 120 (as shown in FIG. 3). As used herein, the term "substantially right angle" refers to an angle of approximately 90°, for the purposes of jewelry wire banding. It will be understood by one of ordinary skill in the art that the angle formed by apparatus 100 need not be precisely 90° to be suitable for use in wire banding applications.

With regard to the above-described sizing of receiving section 116 and projecting section 136, the dimensions of receiving section 116 and projecting section 136 are selected based on the characteristics of the wire to be bent. An example will be described herein for the purposes of illustration. Apparatus 100 may be usable to bend 18 gauge half-round jewelry wire (having a diameter of approximately 1.0 mm). For wire banding applications, this 18 gauge wire will be wrapped around 18 gauge square wire. Thus, it is necessary that there be approximately 1.0 mm of clearance between the right angles formed by apparatus 100 (to allow the bent half-round wire to wrap snuggly around the 18 gauge square wire). Given the diameter of the wire being bent (approximately 1.0 mm) and the desired spacing between bends (approximately 1.0 mm), one of ordinary skill will understand that sidewalls 120 of receiving section 116 should be spaced apart by at least 3 mm, and preferably, around 4 mm (to allow some clearance for the wire being bent). Similarly, projection 138 of projecting section 136 should have a width of approximately 1.0 mm (equivalent to the desired spacing). It will be understood that the above example is provided only for the purposes of illustration, and is not intended to be limiting of the dimensions of apparatus 100.

It will be understood that apparatus 100 is not limited to the above features, but may include additional and/or alternative features, as set forth below.

Apparatus 100 may further include a handle for operation by a user. In an exemplary embodiment, first forming part 110 and second forming part 130 each have a handle section (not shown) positioned at proximal ends 114 and 134. The handle sections are configured to be grasped within the user's hand, to enable pivoting of second forming part 130 relative to first forming part 110. The handle sections of apparatus 100 may be convention pliers handles, as would be understood by one of ordinary skill in the art.

While apparatus 100 is described above as including only a single receiving section 116 and projecting section 136, it will be understood by one of ordinary skill in the art that the invention is not so limited. To the contrary, first forming part 110 may include a plurality of receiving sections, and second forming part 130 may include a plurality of projecting sections. As shown in FIGS. 1-3, first forming part 110 includes a first and second receiving sections 116*a* and 116*b*, and second forming part 130 includes first and second projecting sections 136*a* and 136*b*. Receiving sections 116*a* and 116*b* each include respective bottom surfaces 118 and sidewalls 120. The receiving sections 116*a* and 116*b* form a generally plus-sign configuration between the sidewalls 120. The plus-sign configuration has for arms extending outwardly from a central portion.

Projecting sections 136*a* and 136*b* each include respective projections 138 that are positioned to be receive within the sidewalls 120 of corresponding receiving sections 116*a* and 116*b*. As shown in FIGS. 1-3, the pair of opposing sidewalls 120*a* of receiving section 116*a* are separated by a gap 122 from the pair of opposing sidewalls 120*b* of receiving section 116*b*. Corresponding, projections 138*a* and 138*b* may be separated from each other by a gap, or may be formed as a single continuous projection (as shown in FIGS. 1-3). In this orientation, gap 122 is positioned on an approximate longitudinal centerline of first forming part 110, such that receiving section 116*a* is positioned on one side of the longitudinal centerline, and receiving section 116 *b* is positioned on the opposite side of the longitudinal centerline. Correspondingly, projections 138*a* and 138*b* may be positioned on either side of the longitudinal centerline of second forming part 130, in order to mate with the corresponding receiving sections. The projection section 136*a* and 136*b* has a generally T-shaped configuration having a longitudinally extending base, and a laterally extending cross piece (projections 38*a* and 138*b*). The base of the T-shape extends into one of the four arms of the plus-sign and the cross piece extends into adjacent arms of the one of the four arms of the plus-sign.

When apparatus 100 includes multiple receiving/projecting sections, the sections may preferably be differently sized, in order to accommodate wires having different characteristics or to form right angles having varying distances. Examples of such differentiation are described below.

The distance between sidewalls 120*a* of receiving section 116*a* may be the same or different from the distance between sidewalls 120*b* of receiving section 116*b*. It may be desirable to vary this distance in order to enable different receiving sections 116 of apparatus 100 to be usable to bend different gauges of wire (due to their different diameters). For example, receiving section 116*a* and projecting section 136*a* may be sized to bend a first wire having a first cross-sectional width (e.g., an 18 gauge wire) into a pair of substantially right angles, while receiving section 116*b* and projecting section 136*b* may be sized to bend a second wire having a second cross-sectional width (e.g., a 22 gauge wire) into a pair of substantially right angles. Similarly, the height of sidewalls 120*a* of receiving section 116*a* may be the same or different from the height of sidewalls 120*b* of receiving section 116*b*.

The width of projection 138*a* of projecting section 136*a* may also be the same or different from the width of projection 138*b* of projecting section 136*b*. It may be desirable to vary their widths in order to enable different receiving sections to form right angles at different distances. For example, receiving section 116*a* and projecting section 136*a* may be sized to form a pair of right angles that are spaced apart a first difference (e.g., for wrapping around an 18 gauge wire), while receiving section 116*b* and projecting section 136*b* may be sized to form a pair of right angles that are spaced apart a second difference (e.g., for wrapping around a 22 gauge wire or for wrapping around two side-by-side lengths of 18 gauge wire).

Figure 4:
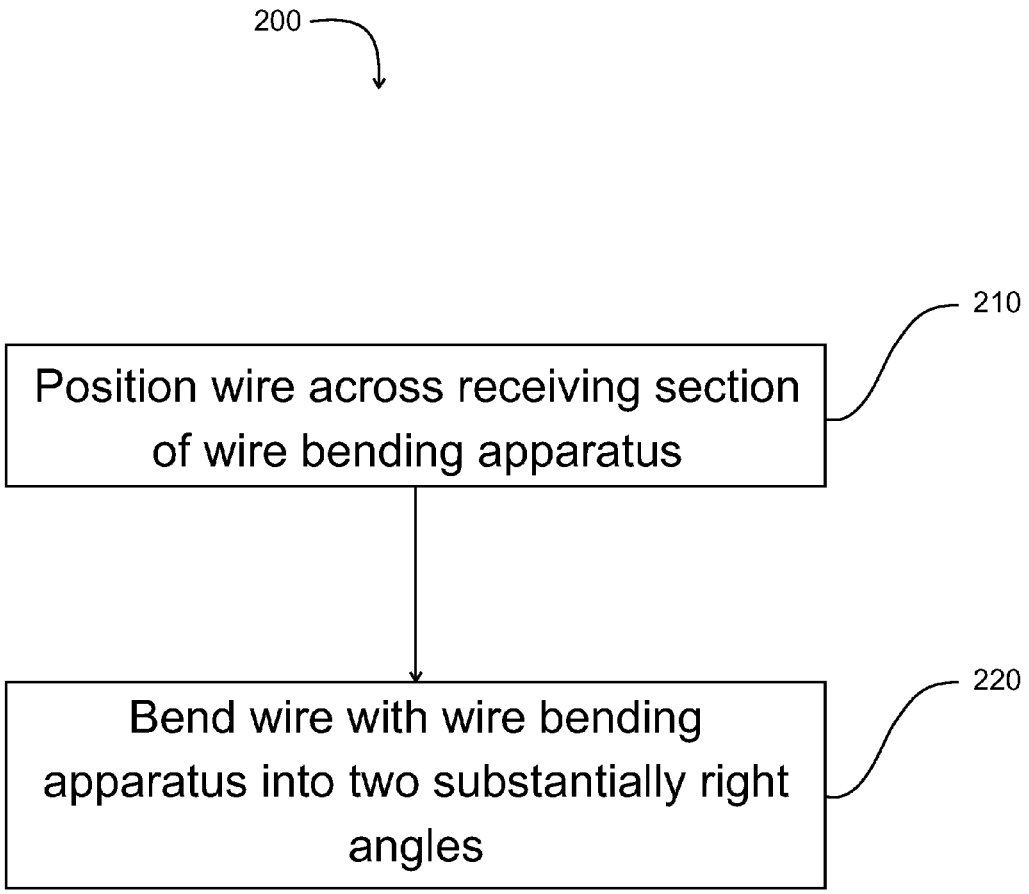
FIG. 4 is a flowchart illustrating an exemplary method for bending wire in accordance with aspects of the present invention.

FIG. 4 illustrates an exemplary method 200 for bending wire in accordance with aspects of the present invention. Method 200 is usable to bend wire into a form usable for jewelry wire banding applications. As a general overview, method 200 includes positioning wire within a wire bending apparatus and bending the wire. Additional details of method 200 are described below with respect to the components of apparatus 100.

In step 210, wire is positioned in the wire bending apparatus. In an exemplary embodiment, a wire to be bent is laid across the receiving section 116 of apparatus 100. As shown in FIG. 2, the wire is positioned such that it is approximately perpendicular to sidewalls 120 of receiving section 116, with the portion of the wire to be bent positioned between sidewalls 120 and directly over bottom surface 118.

In step 220, the apparatus is actuated. In an exemplary embodiment, second forming part 130 is pivoted around joint 150 relative to first forming part 110. During this rotating, projection 138 contacts the wire to be bent, and forces it downward into the space between sidewalls 120. As shown in FIG. 3, when projection 138 is fully rotated, it is positioned within the space between sidewalls 120, thereby bending the wire into a pair of substantially right angles.

Step 220 is completed when apparatus 100 is in a fully closed position, which will complete the bending of the wire into the pair of substantially right angles. It may be desirable that step 220 be completed in a single pivot of second forming part 130 relative to first forming part 110, i.e., in a single bending movement, rather than in multiple, incremental bending operations. This may be desirable to form a cleaner and more aesthetically-pleasing wire bend.

It will be understood that method 200 is not limited to the above steps, but may include additional and/or alternative steps, as set forth below.

As set forth above, apparatus 100 may include a plurality of receiving sections 116 sized to receive/bend different gauges of wire and/or to bend wire to be wrapped around different gauges of wire. Accordingly, prior to bending the wire it may be necessary to properly select a suitable receiving section 116 based on the wire banding to be performed. This step may include selecting one of a plurality of receiving sections based on a cross-sectional width of the wire to be bent. This step may alternatively or additionally include selecting one of a plurality of receiving sections based on a desired distance between the pair of substantially right angles formed in the bending step.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. An apparatus for bending wire comprising:

a first forming part and a second forming part pivotably connected to the first forming part and a joint, each of the first and second forming part having a respective proximal end and a respected distal end positions on opposing sides of the joint;

the first forming part having a receiving section at the distal end thereof, the receiving section having a bottom surface and a pair of opposing sidewalls extending from the bottom surface in a direction toward the second forming part, the receiving section having a generally plus-sign configuration between the sidewalls, the plus-sign configuration having four arms extending outwardly from a central portion;

the second forming part having a projecting section at the distal end thereof, the projecting section having a projection extending toward the first forming part, the projecting section having a generally T-shaped configuration having a longitudinally extending base, and a laterally extending cross piece, the projection positioned to be received in the receiving section, such that the base extends into one of the four arms and the cross piece extends into adjacent arms of the one of the four arms, wherein the receiving section and the projecting section are sized to bend wire into a pair of substantially right angles when the wire is positioned between the receiving section and the projecting section and when the second forming part is pivoted such that the projection is received between the pair of opposing sidewalls.

2. The apparatus of claim 1, wherein each of the first and second forming part having handle section at the respective proximal ends thereof, the handle section is configured to be grasped within a hand of a user to enable pivoting of the second forming part relative to the first forming part.

3. The apparatus of claim 1, wherein the first forming part has a plurality of receiving sections, each receiving section having a bottom surface and a pair of opposing sidewalls; and the second forming part has a plurality of projecting sections, each projecting section having a projection positions to be received between the pair of opposing sidewalls of their respective receiving section.

4. The apparatus of claim 3, wherein the pair of opposing sidewalls of a first of the plurality of receiving sections is separated from the pair of opposing sidewalls of a second of the plurality of receiving sections by a gap.

5. The apparatus of claim 3, wherein the first forming part and the second forming part extend in a longitudinal direction from the joint;

the plurality of receiving sections include a first receiving section on one side of a longitudinal centerline of the first forming part and a second receiving section on an opposite side of the longitudinal centerline of the first forming part; and the plurality of projecting sections include a first projecting section on one side of a longitudinal centerline of the second forming part and a second projecting section on an opposite side of the longitudinal centerline of the second forming part.

6. The apparatus of claim 3, wherein a distance between the pair of opposing sidewalls of a first of the plurality of receiving sections is the same as a distance between the pair of opposing sidewalls of a second of the plurality of receiving sections.

7. The apparatus of claim 3, wherein a distance between the pair of opposing sidewalls of a first of the plurality of receiving sections is different from a distance between the pair of opposing sidewalls of a second of the plurality of receiving sections.

8. The apparatus of claim 3, wherein a height of the pair of opposing sidewalls of a first of the plurality of receiving sections is the same as a height of the pair of opposing sidewalls of a second of the plurality of receiving sections.

9. The apparatus of claim 3 a height of the pair of opposing sidewalls of a first of the plurality of receiving sections is different from a height of the pair of opposing sidewalls of a second of the plurality of receiving sections.

10. The apparatus of claim 3, wherein a first of the plurality of receiving sections and a respective first of the plurality of projecting sections are sized to bend a first wire having a first cross-sectional width into a pair of substantially right angles; and a second of the plurality of receiving sections and a respective second of the plurality of projecting sections are sized to bend a second wire having a second cross-sectional width into a pair of substantially right angles.

11. A method for bending wire comprising the steps of:

positioning half-round wire or square wire across the receiving section of the apparatus of claim 1; and pivoting the second forming part relative to the first forming part such that the projection contacts the wire and is received between the pair of opposing sidewalls, thereby bending the wire into a pair of substantially right angles.

12. The method of claim 11, wherein the pivoting step is completed in a single pivot of the second forming part relative to the first forming part.

13. The method of claim 11, wherein the apparatus comprises a plurality of receiving sections, and further comprising the step of:

selecting one of the plurality of receiving sections based on a cross-sectional width of the wire.

14. The method of claim 11, wherein the apparatus comprises a plurality of receiving sections, and further comprising the step of:

selecting one of the plurality of receiving sections based on a desired distance between the pair of substantially right angles.

15. The method of claim 11, wherein the pair of substantially right angles comprises only to substantially right angles.

16. An apparatus for bending wire comprising:

a first forming part extending along a first axis and having a first proximal end and a first distal end, the first forming part having a receiving section at the first distal end, the receiving section having a forward sidewall, a pair of rear sidewalls, each of the rear sidewalls extending alongside the first axis, and a gap extending orthogonally to the first axis between the forward sidewall and the pair of rear sidewalls; and a second forming part pivotally coupled to the first forming part, the second forming part extending along a second axis and having a second proximal end and a second distal end, the second forming part having a projecting section at the second distal end, the projecting section positioned to be received between pair of rear sidewalls and in the gap;

wherein the second forming part is generally T-shaped and having a base extending the second forming part of rear sidewalls and a cross piece extending into the gap.

17. The apparatus of claim 16, wherein the forward sidewall comprises a pair of forward sidewalls, each of the pair of forward sidewalls extending alongside the first axis.

18. The apparatus of claim 17, wherein the gap has a first size between one of the pair of forward sidewalls and one of the pair of rear sidewalls, and the gap has a second size between the other of the pair of forward sidewalls and the other of the pair of rear sidewalls.

19. The apparatus of claim 16, wherein when a wire is inserted parallel to the first axis, and when the projecting section is inserted into the receiving section, the wire inserted in the receiving section is bent to form right angles in only two locations.

* * * * *